US006904886B2

(12) United States Patent
Capodiferro

(10) Patent No.: US 6,904,886 B2
(45) Date of Patent: Jun. 14, 2005

(54) ENGINE TIMING

(75) Inventor: Romeo Capodiferro, Turin (IT)

(73) Assignee: Cummins Engine Company, Ltd., Darlington (GB)

( * ) Notice: Subject to any disclaimer, the term of this patent is extended or adjusted under 35 U.S.C. 154(b) by 0 days.

(21) Appl. No.: 10/603,068

(22) Filed: Jun. 24, 2003

(65) Prior Publication Data

US 2004/0069264 A1 Apr. 15, 2004

(30) Foreign Application Priority Data

Jun. 27, 2002 (GB) ..... 0214862

(51) Int. Cl.[7] ..... F02N 1/00
(52) U.S. Cl. ..... 123/195 C
(58) Field of Search ..... 74/116, 119 R, 74/6, 7 B; 33/600, 605, 606; 123/195 C, 198 R, 179.22, 179.24; 29/240, 271

(56) References Cited

U.S. PATENT DOCUMENTS

| | | | | | |
|---|---|---|---|---|---|
| 3,321,985 | A | * | 5/1967 | Wheeler | 74/325 |
| 3,395,588 | A | * | 8/1968 | Bleigh et al. | 74/405 |
| 4,570,334 | A | | 2/1986 | Melzer et al. | |
| 4,580,534 | A | | 4/1986 | Blum et al. | |
| 4,895,016 | A | | 1/1990 | Cameron et al. | |
| 4,930,371 | A | * | 6/1990 | Schneider | 74/527 |
| 4,939,371 | A | | 7/1990 | Goto | |
| 5,440,947 | A | * | 8/1995 | Manganelli | 74/527 |
| 5,460,138 | A | | 10/1995 | Hasegawa | |
| 6,145,375 | A | * | 11/2000 | Holler | 73/116 |

FOREIGN PATENT DOCUMENTS

| | | |
|---|---|---|
| DD | 0121698 | 2/1984 |
| DE | 19503362 | 2/1995 |
| JP | 10047222 A | 2/1998 |

* cited by examiner

*Primary Examiner*—Henry C. Yuen
*Assistant Examiner*—Arnold Castro
(74) *Attorney, Agent, or Firm*—Woodard, Emhart, Moriarty, McNett & Henry LLP

(57) ABSTRACT

A method is disclosed for positioning the crankshaft of an engine. The method comprises the steps of providing a first hole in the flywheel, providing a hole in a stationary part of the engine to line up accurately with the hole in the flywheel once during each crankshaft revolution, manually cranking the engine until the holes in the flywheel and the engine are aligned, and inserting a pin into the aligned holes to lock the crankshaft in a predetermined angular position.

4 Claims, 3 Drawing Sheets

ENGINE TIMING

FIELD OF THE INVENTION

The present invention relates to engine timing.

BACKGROUND OF THE INVENTION

When assembling and repairing engines, it is important to achieve precise synchronisation between the operation of various mechanical components. For example, the timing of the operation of the cams that actuate the intake and exhaust valves of any engine or the timing of the operation of the injectors of a fuel injection pump in a compression ignition (diesel) engine are crucial for correct engine operation.

Engines can be designed so that the crankshaft driven cogs that drive ancillary equipment, such as the mechanical fuel injection pump of a diesel engine, are located either at the front end or the rear end of the engine. When the drive cogs are arranged at the front of the engine, they can be accessed relatively simply and proper timing can be set by ensuring that timing marks, that are provided for this purposes on the various cogs, line up with one another.

However, when ancillary equipment is driven by cogs at the rear of the engine, the transmission fitted to the engine prevents the drive cogs from being inspected or accessed and this makes it difficult to guarantee that ancillary equipment, such as a fuel injection pump, is refitted with the correct timing after it has been removed for servicing.

The present invention seeks therefore to enable precise location of an engine crankshaft during engine servicing to permit ancillary equipment to be fitted to the engine with correct timing.

SUMMARY OF THE INVENTION

According to a first aspect of the invention, there is provided a method of positioning the crankshaft of an engine having a flywheel fitted to the engine crankshaft, the method comprising the steps of:

providing a first hole in the flywheel, providing a second hole in a stationary part, of the engine to line up accurately with the hole in the flywheel once during each crankshaft revolution, manually cranking the engine until the holes in the flywheel and the engine are aligned, and inserting a locking pin into the aligned holes to lock the crankshaft in a predetermined angular position.

Where the flywheel has external teeth that are engaged by the driving cog of an electrical starter motor, the step of manually cranking the engine preferably comprises:

removing the starter motor, mounting on the engine using the same mounting surface as the starter motor a manual cranking device having a cog that meshes with the teeth on the flywheel and that is secured to a shaft rotatable by means of a cranking handle, and rotating the flywheel by means of the cranking handle to position the flywheel.

Advantageously, the hole in the engine that receives the locking pin is located in such a manner as to prevent replacement of the engine starter motor while the locking pin is in place in the aligned holes.

To assist in alignment of the holes and insertion of the locking pin, it is preferred to form the hole in the flywheel so that it is not normal to the end surfaces of the flywheel.

According to a second aspect of the invention, there is provided an internal combustion engine having a crankshaft, a toothed flywheel mounted on the crankshaft, a starter motor have a driving cog that meshes with the teeth of the flywheel, a housing enclosing the flywheel, a first hole formed in the flywheel, and a second hole formed in the housing to line up accurately with the hole in the flywheel once during each crankshaft revolution, wherein the hole in the housing is covered by the starter motor and is only accessible after removal of the starter motor.

In a further aspect of the invention, there is provided a manual cranking device for use with an engine as set forth above, comprising:

a casing for mounting to the engine in place of the starter motor, a shaft journalled in the casing, a cog fast in rotation with one end the shaft for meshing with the teeth of the engine flywheel, and a connector at the other end of the shaft for receiving a cranking handle to permit the flywheel to be cranked manually, the casing being shaped to avoid obstruction of the hole in the flywheel housing so as to permit a locking pin to be inserted into and removed from the aligned holes in the flywheel and the housing while the cranking device is fitted to the engine.

In a two-stroke engine, it suffices to ensure that the crankshaft is in a predetermined position when setting the timing of ancillary equipment. In a four-stroke engine, it is of course additionally necessary to ensure that the engine is operating in the correct stroke. For example, if the holes in the flywheel and housing line up at top dead centre of a given engine cylinder, it is additionally necessary to be able to ascertain if the piston has just completed the compression stroke or the exhaust stroke.

To ensure that a four-stroke engine is operating in the correct stroke, it is possible to provide a timing marking on a camshaft that is rotated at half engine speed and to inspect the position of the timing mark prior to locking the crankshaft by inserting a locking pin into the aligned holes in the flywheel and the flywheel housing.

A dedicated inspection window may be provided to view the timing marks on the camshaft. However, in some engines, a lobe is provided on the camshaft to operate a mechanical fuel pump and in this case the timing markings may be provided near the cam lobe that operates the fuel pump. In such a case, without the additional expense of a dedicated inspection window, it is possible to determine the position of the camshaft by removal of the fuel pump, a task that can be performed simply and quickly.

SUMMARY OF THE DRAWINGS

The invention will now be described further, by way of example, with reference to the accompanying drawings, in which.

DESCRIPTION OF THE PREFERRED EMBODIMENT

Figure 1:
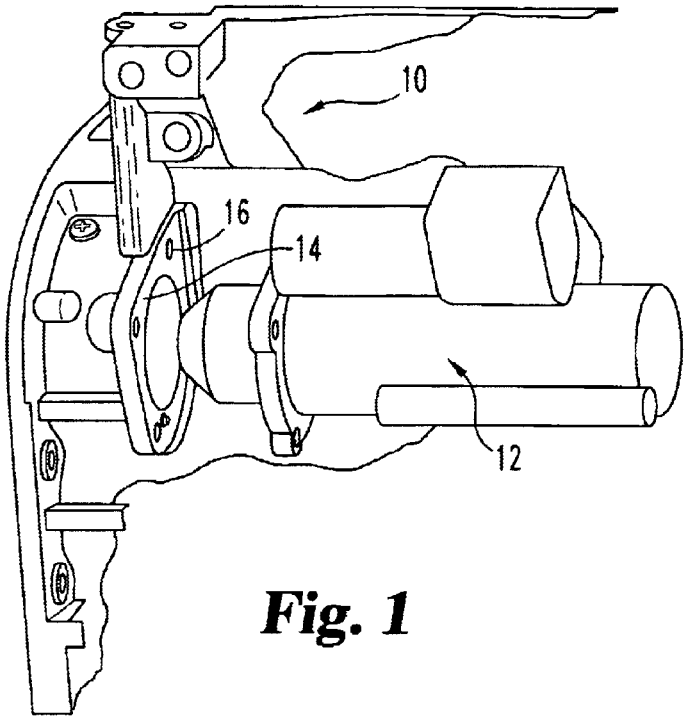
FIG. 1 is a side view of a diesel engine for an agricultural vehicles.

FIG. 1 shows an engine 10 having a starter motor 12 that is secured to the rear of the engine on a mounting surface 14. FIG. 1 shows the starter motor withdrawn from its normal position to expose the mounting surface 14 which has three holes 16 to enable the starter motor 12 to be bolted in position during normal operation.

Figure 2:
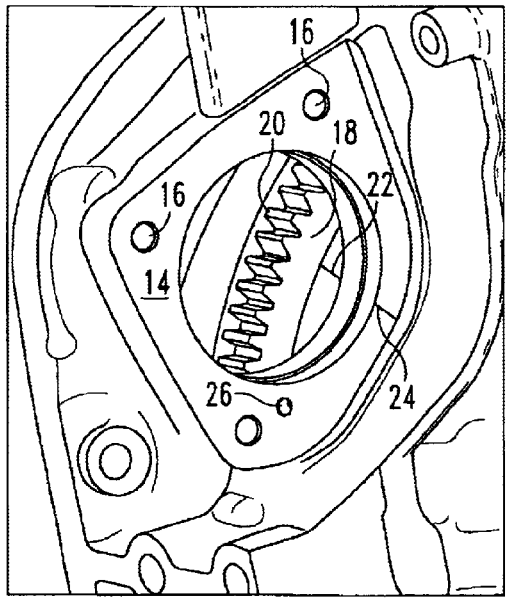
FIG. 2 is a detail of the engine of FIG. 1 showing the mounting surface for the starter motor after the starter motor has been removed.

The mounting surface 14 and the holes 16 are better seen in FIG. 2 in which it is also possible to see part of the flywheel 18 that is bolted on to the engine crankshaft. The flywheel 18 has external teeth 20 that mesh with a cog of the starter motor 12 to enable the engine to be cranked by the starter motor. The flywheel has a marking 22 which when lined up with a marking 24 on the mounting surface 14 indicates that the first engine cylinder is near TDC. When the crankshaft is exactly at TDC, a hole in the flywheel (partly shown in FIG. 6) lines up precisely with a hole 26 formed in the starter motor mounting surface 14.

When mounting ancillary equipment (or re-mounting it after servicing), such as a diesel fuel injection pump, that needs to be accurately timed in relation to the crankshaft, the engine is rotated manually, as is described below, to align the hole 26 with the corresponding hole formed in the flywheel. A locking pin (designated 68 in FIGS. 5 and 6) is inserted into the hole 26 and the hole in the flywheel to lock the crankshaft in the TDC position of the first engine cylinder. If the engine is a four stroke engine, it can be ascertained that the cylinder is at the end of the correct stroke by examining timing markings on a camshaft that turns with the crankshaft at half the engine speed. Most simply, this can be effected by providing timing markings near a lobe of the camshaft that drives a mechanical fuel pump, as the timing marking can then be seen by simple removal of the fuel pump.

With the crankshaft firmly locked in a position in which the first cylinder is exactly at the top dead centre of its compression stroke, ancillary equipment can be removed for servicing. To guarantee correct timing, it is only necessary to ensure that the ancillary equipment is subsequently replaced in the same orientation as when it was removed. Most ancillary equipment of which synchronisation with the engine strokes is required, have special markings allowing a setting corresponding to TDC of the engine. In this way, it is sufficient after removal of the ancillary equipment to set the engine to TDC and to re-install the ancillary equipment afterwards ensuring that this equipment also has been set for TDC position.

Figure 3:
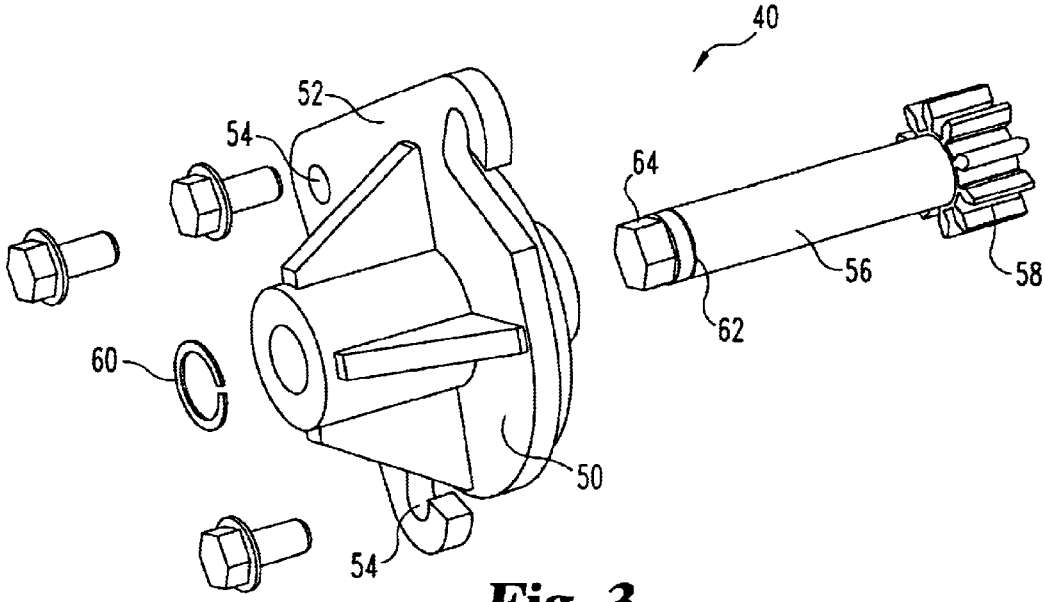
FIG. 3 is en exploded perspective view of a mechanical cranking device for mounting in place of the engine starter motor to enable the engine flywheel to be cranked manually.
Figure 4:
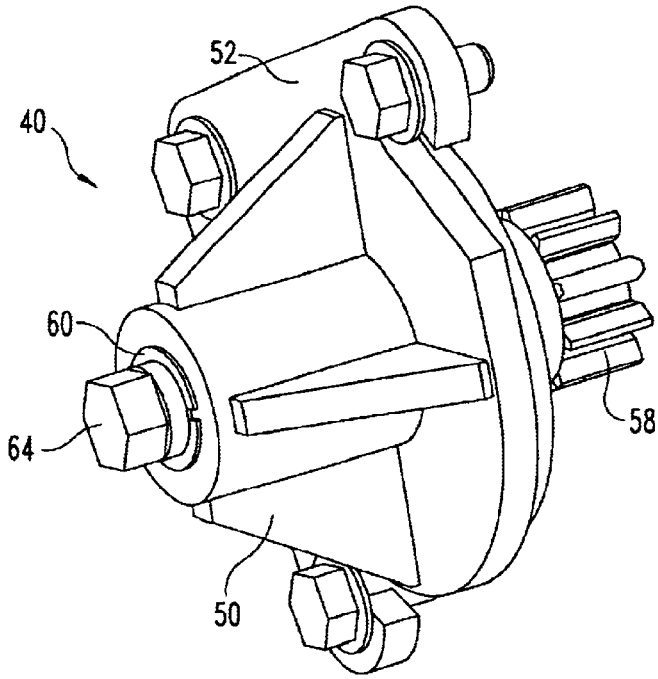
FIG. 4 is a perspective view of the cranking device of FIG. 3 in its assembled condition.
Figure 5:
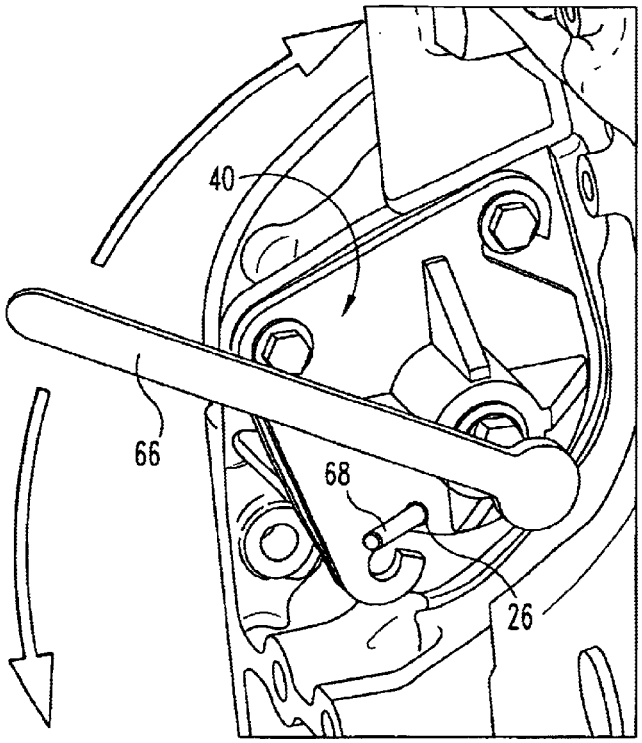
FIG. 5 is a view similar to that of FIG. 2 showing the cranking device mounted on the engine.

To turn the engine manually, a cranking device as shown in FIGS. 3 to 5 is bolted on to the mounting surface 14 for the starter motor. The cranking device 40 comprises a casing 50 having a mounting flange 52 similar to that of the removed starter motor with bolt holes 54 that line up with the holes 16 in the mounting surface 14. A shaft 56 is journalled in the casing 50 and is fast in rotation at one end with a cog 58 that meshes with the teeth of the flywheel 18. The shaft 56 is retained in the casing 50 by means of a clip 60 received in an annular groove 62 in the opposite end of the shaft 56 and this end of the shaft 56 also has a hexagonal head 64 to enable it to be turned by means of a suitable cranking handle or wrench 66 that incorporates a ratchet mechanism.

Figure 6:
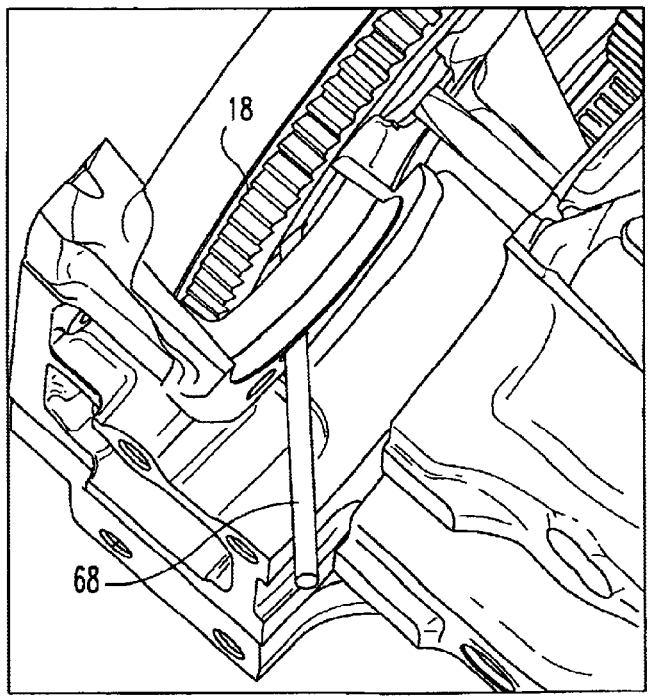
FIG. 6 is a perspective view with part of the engine cut away showing a locking pin inserted into a hole in the flywheel to prevent rotation of the crankshaft.

After removal of the starter motor, the cranking device 40 is bolted to the engine and this enables the flywheel to be turned by means of the cranking handle 66. The length of the handle and the high gearing ratio between the cog 58 and the flywheel 18 ensure that little effort is required to rotate the crankshaft. When the first engine cylinder reaches TDC at the end of its compression stroke, the hole in the flywheel 18 lines up with the hole 26. A locking pin 68 (which may have a tapered end to facilitate its location and insertion) is then driven through the hole 26 into the flywheel to lock the crankshaft in the TDC position, as shown in FIG. 6.

The position of the hole 26 in the mounting surface 14 for the starter motor offers the advantage that no special steps need be taken to seal the hole 26 during normal engine use as it is covered by the mounting flange of the starter motor 12. Furthermore, the protruding pin 68 prevents the starter motor from being remounted on the engine so that there is no risk or danger of an attempt being made to operate the engine with the locking pin 68 still in place.

It will also be noted that the hole 26 is arranged at an angle to the flywheel. This makes it easier to see when the holes are aligned and also affords better access for insertion of the locking pin 68.

Having thus described the invention what is claimed as novel and desired to be secured by Letters Patent of the United States is:

1. A method of positioning the crankshaft of an engine having a flywheel fitted to the engine crankshaft and having external teeth that are engaged by a driving cog of a starter motor, characterized in that the method comprises the steps of:

providing a first hole in the flywheel, providing a second hole in a stationary part of the engine to line up accurately with the hole in the flywheel once during each crankshaft revolution, removing the starter motor, mounting on the engine using the same fixings as the starter motor a manual cranking device having a cog that meshes with the teeth on the flywheel and that is secured to a shaft rotatable by means of a cranking handle, rotating the flywheel by means of the cranking handle until the holes in the flywheel and the stationary part of the engine are aligned, and inserting a locking pin into the aligned holes to lock the crankshaft in a predetermined angular position wherein the hole in the engine that receives the locking pin is located in such a manner as to prevent replacement of the engine starter motor while the locking pin is in place in the aligned holes.

2. A method according to claim 1 characterized in that the hole in the flywheel is formed so that it is not normal to the end surfaces of the flywheel.

3. An internal combustion engine having a crankshaft, a toothed flywheel mounted on the crankshaft, a starter motor have a driving cog that meshes with the teeth of the flywheel, a housing enclosing the flywheel, a first hole formed in the flywheel, and a second hole formed in the housing to line up accurately with the hole in the flywheel once during each crankshaft revolution, and characterized in that the hole in the housing is covered by the starter motor and is only accessible after removal of the starter motor.

4. A manual cranking device for use with an engine as claimed in claim 3, and characterized in that the device comprises:

a casing for mounting to the engine in place of the starter motor, a shaft journalled in the casing, a cog fast in rotation with one end of the shaft for meshing with the teeth of the engine flywheel, and a connector at the other end of the shaft for receiving a cranking handle to permit the flywheel to be cranked manually, the casing being shaped to avoid obstruction of the hole in the flywheel housing so as to permit a locking pin to be inserted into and removed from the aligned holes in the flywheel and the housing while the cranking device is fitted to the engine.

* * * * *